US005927201A

United States Patent [19]

Birkenfeld et al.

[11] Patent Number: 5,927,201

[45] Date of Patent: Jul. 27, 1999

[54] DEVICE AND PROCESS FOR CARRYING THROUGH QUALITY MANAGEMENT

[75] Inventors: Andreas Birkenfeld, Dinkelscherben; Karl-Heinz Reichel-Langer, Wemding, both of Germany

[73] Assignee: Baldwin Grafotec GmbH, Augsburg, Germany

[21] Appl. No.: 08/987,588

[22] Filed: Dec. 10, 1997

[30] Foreign Application Priority Data

Feb. 19, 1997 [DE] Germany ..... 197 06 412

[51] Int. Cl.[6] ..... B41F 31/02

[52] U.S. Cl. ..... 101/365; 101/211; 382/112

[58] Field of Search ..... 101/365, 211, 101/483, 348; 382/112, 162, 321, 322, 323

[56] References Cited

U.S. PATENT DOCUMENTS

| | | | |
|---|---|---|---|
| 4,975,862 | 12/1990 | Keller et al. | 364/526 |
| 5,122,977 | 6/1992 | Pfeiffer | 364/551.01 |
| 5,182,721 | 1/1993 | Kipphan et al. | 364/526 |
| 5,369,494 | 11/1994 | Bowden et al. | 356/402 |
| 5,551,342 | 9/1996 | Fuchs et al. | 101/484 |
| 5,673,112 | 9/1997 | Schramm | 356/402 |
| 5,724,437 | 3/1998 | Bucher et al. | 382/112 |

*Primary Examiner*—Edgar Burr
*Assistant Examiner*—Dave A. Ghatt
*Attorney, Agent, or Firm*—Jones, Tullar & Cooper, P.C.

[57] ABSTRACT

In carrying through quality management while printing a web on a rotational roller printing machine high accuracy is obtained by a periodic returning, simultaneous measuring of color density and spectral distribution in at least one selected point of the periodically returning printing pattern; the continuous registration and storing of the measuring results over the entire duration of the production process; an analysis of the measured results by predetermined criteria at least at the end of production. For doing so a device is provided with at least one adjustable measuring head spanning the width of the printed web, containing a spectrometer and a light source; the measuring head can be activated depending on the product by means of an encoder assigned to the rotational roller printing machine. Further, a control device is provided that can continuously record the measuring signals of each measuring head.

15 Claims, 2 Drawing Sheets

FIG. 2
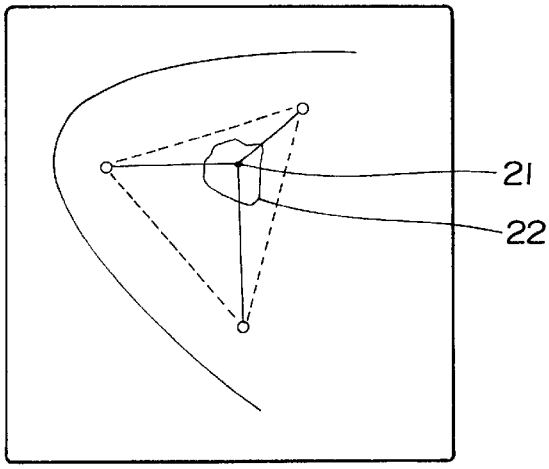
FIG. 3
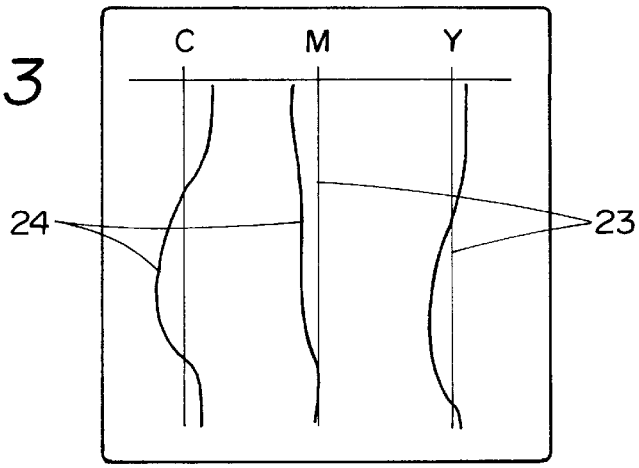
FIG. 4
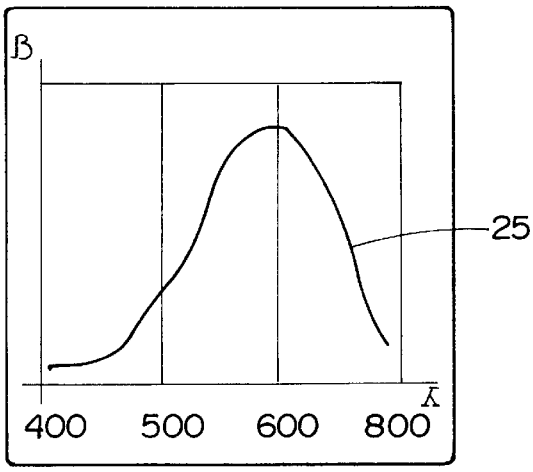
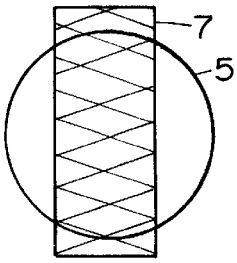
FIG. 5

DEVICE AND PROCESS FOR CARRYING THROUGH QUALITY MANAGEMENT

FIELD OF THE INVENTION

The present invention relates to a device and process for carrying through quality management while printing a web on a rotational roller printing machine.

BACKGROUND OF THE INVENTION

It has up to now been customary to take out and measure a printed specimen. Thus, a continuous registration of the printed specimens is not possible. Further, the results cannot easily be assigned to the production process because the specimens are not automatically marked.

It has been proposed to provide rotational sheet printing machines with a sheet inspection system, arranged in an extended line of the sheet deposit where each sheet produced is photographed by several video cameras and compared with a so-called master sheet. Deviations of the quality produced from the quality of the master sheet will be indicated. In case of undue deviations the respective sheets can be marked or singled out. The measured values are not recorded.

The speed of the video cameras employed, to register the whole sheet, is relatively slow. For this very reason the known arrangement is not suitable for rotational roller printing machines. With a rotational sheet printing machine the relatively low speed is of minor importance, since the speed of production is only relatively low. Further, video cameras cannot register the spectral distribution, unless great efforts are made. Only the basic colors are therefore registered. To this end special filters are provided. The colors between the three basic colors have to be interpolated, thus resulting in relatively high inaccuracy.

SUMMARY OF THE INVENTION

Accordingly, it is therefore an object of the present invention to provide a device and process for carrying through quality management in rotational roller printing machines such that inline measuring without limiting the speed of production is ensured while high accuracy is maintained.

The device underlying the object of the present invention is realized by a device for carrying through quality management while printing a web on a rotational roller printing machine with at least one measuring head spanning the width of the printed web and adjustable over the width containing a spectrometer and a light source, and which can be activated depending on the product by means of an encoder assigned to the rotational roller printing machine, and with a control device which can continuously record the measuring signals of each measuring head. Accordingly, at least one adjustable measuring head containing a spectrometer and a light source which span the printed web are provided. This measuring head can be activated, depending on the product, by means of an encoder assigned to the rotational roller printing machine. Further, a control device is provided that can continuously record the measuring signals of each measuring head.

The process underlying the object of the present invention is one which carries through quality management while printing a web on a rotational roller printing machine, where a periodic, simultaneous measurement of color density and spectral distribution in at least one selected point of the periodically returning printing pattern is carried out, where the measurement results during production are continuously measured and stored, and where at least at the end of the production, an analysis by predetermined criteria is carried through. Accordingly, it is possible to carry through a periodic, simultaneous measurement of color density and spectral distribution in at least one selected point of the periodically returning printing pattern; further, to continuously record and store the measurement results during production and to carry through an analysis by predetermined criteria at least at the end of the production.

Due to laterally adjusting the measuring heads and their triggering by the encoder, practically all positions on the printed web can be reached. This allows the operator to choose crucial areas and to assign them a measuring head.

Since the entire visible spectral range is measured, high accuracy between the three basic colors is achieved. The continuous registration and recording of the values measured enables an exact control and in particular an exact quality check; this is of importance, if the customer complains about the quality later, as is often said to happen, especially in printing large ads, etc. Storing of the measured values during the entire production process facilitates various charts in an advantageous way, showing existing deviations at a glance. At the same time, however, it is possible to monitor the measured results during the production process and to intervene as soon as the tolerance limits are exceeded and to provide for the keeping of the predetermined tolerances and for marking or singling out spoiled webs. The object of the invention has thus solved the problem in a highly economical way.

Advantageous embodiments and expedient developments of the above-mentioned measures will become evident from the following description of the embodiment taken in conjunction with the accompanying drawing, which illustrates, by way of example, the principles of the invention.

BRIEF DESCRIPTION OF THE DRAWINGS:

FIG.2 is an example of a representation of a color point assigned to a measuring point;

FIG. 3 is an example of a time-density-diagram assigned to a measuring point;

FIG. 4 is an example of a spectral distribution diagram assigned to a measuring point;

FIG. 5 is a partial top view showing the relative dimensions of the measuring head and a measuring field according to one embodiment of the present invention.

DESCRIPTION OF THE PREFERRED EMBODIMENT

Figure 1:
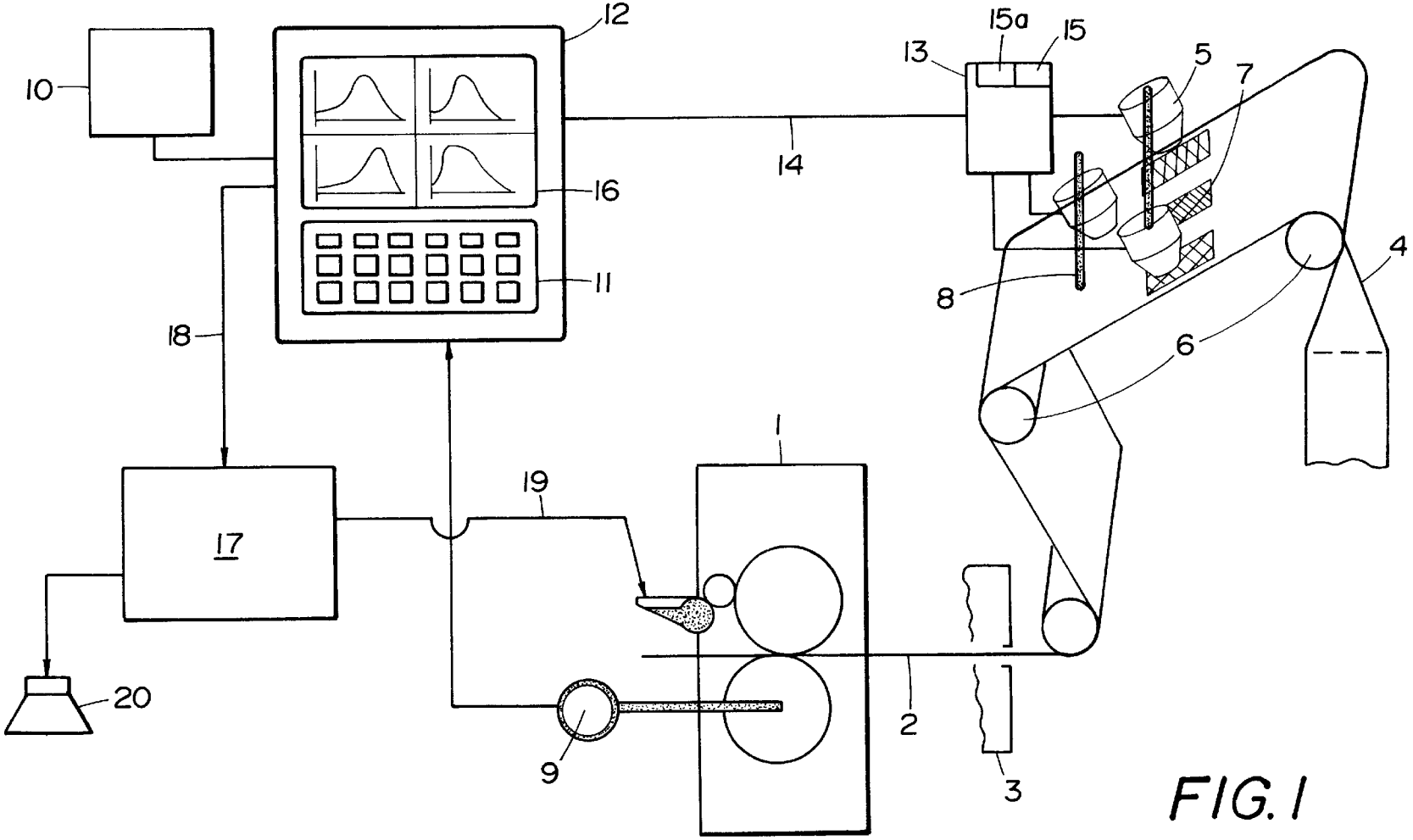
FIG. 1 is a schematic view of a device according to the present invention with signal flow arrows.

FIG. 1 only indicates the last printing group representing a rotational roller printing machine by which a printed web 2 is printed. The rotational roller printing machine 1 can be an offset-rotational roller printing machine. The construction of such machines and the way they work is known and do not require any further explanation.

A dryer 3 is arranged behind the rotational roller printing machine 1; a cooling device, not explained in detail, can be arranged behind the dryer 3. The printed web 2 is then passed through a folding device 4, simply indicated by a former. Within the area between the dryer 3 and the assigned cooling device respectively and the folding device 4, the printed web 2 passes through a measuring device comprising several measuring heads 5. To avoid flapping, a relatively short web section, limited by two idle rollers 6, is assigned to the measuring device.

By means of the measuring heads 5, the color density and the spectral distribution of the color are simultaneously measured in selected points and/or point areas 7 in the periodically returning printing pattern in the printed web 2. The measuring heads can be laterally shifted along cross pieces 8 arranged at right angles to the printed web 2 and can be adjusted manually and/or by assigned drive motors along the cross pieces 8. In order to reach the assigned measuring point, the measuring heads 5 are shifted along the assigned cross piece 8 corresponding to the lateral coordinate of the assigned measuring point. In the circumferencial direction the measuring point is determined by a high resolution encoder 9 that is activated by the rotational roller printing machine; the encoder 9 provides the trigger point for triggering each measuring head 5 in each assigned measuring point.

The measuring heads 5 contain a spectrometer which, when triggered, registers simultaneously the spectral distribution of the color and color density in the assigned measuring field 7. Each time the periodically returning measuring field 7 on the printed web 2 passes through under the assigned measuring head 5, the spectrometer is triggered.

To ensure a reliable measurement, the measuring heads 5 contain an exposure device. It may be a permanently lighting quarz light or preferably a flash which is periodically triggered together with the spectrometer, thus ensuring high light intensity while the energy required is relatively low.

A control device is assigned to the measuring device. The control device comprises a central processing unit 12 which contains a recording memory 10, it receives the signals of the encoder 9, and has an intersection to the operator, for example a keyboard 11; it further contains a sub unit 13 for locally operating the measuring heads 5. By means of the central processing unit 12 the commands provided by the operator and the encoder 9, the control signals for setting and activating the measuring heads 5 are determined. The operator enters the coordinates of the respective measuring point. The above-mentioned control signals pass through the signal line 14 to the subsequently arranged sub unit 13 which operates the measuring heads 5 locally. To shorten the lateral adjustment of the measuring heads 5 a manual presetting can be carried through so that finally only a fine setting is required.

During operation the sub unit 13 simultaneously processes the data delivered by the measuring heads 5 such that they can be passed to the central processing unit 12 through a suitable intersection. This is illustrated in the example by arrows of the signal line 14 pointing in both directions. The data passed on to the central processing unit 12 are processed by the central processing unit 12 according to color density and spectral distribution and continuously stored by the recording memory 10 during the whole length of the production.

To ensure high accuracy in the measurements carried through by the measuring heads 5, a reference measurement is carried through parallel to the measuring by the measuring heads 5. The corresponding reference measuring device 15 is assigned to sub unit 13. A further measurement for achieving high accuracy consists in balancing temperature fluctuations that influence the measuring results. To this end a compensation device 15*a* is provided which is also assigned to the sub unit 13; the compensation device 15*a* can compensate temperature fluctuations by way of calculation occurring in the measuring area according to a predetermined program. The temperature can be registered through analysis of the signals (dark values) emitted by the measuring heads 5 while the exposure devices are not activated so that additional temperature feelers are not required, as the signals (dark values) are dependent on the temperature.

Further, mistakes, caused by stray light, are to be eliminated. In order to achieve this, each one of the measuring heads 5 are provided with a tube-shape housing whose front opening is situated very close to the paper run 2 thus creating only a small gap through which stray light can penetrate. The diameter of the tube-shaped housing of the measuring heads 5 is larger than the diameter of the field to be measured (FIG. 5). thus reducing the intensity of the stray light within the measuring field. Further, the intensity of the light emitted by the light exposure device is set at a very high level, thus reducing the effect of the stray light. In order to eliminate reflections on a glossy background the light is passed under glassfibres at an angle of preferably 45° towards the paper surface.

The current values measured by the measuring heads 5 will be represented in an advantageous way. To this end, a display device 16 is provided which can be controlled by the central processing unit 12 of the control device. A suitable display field can be assigned to each one of the measuring heads 5.

As illustrated, the central processing unit 12 of the control device can be connected to the control device 17 of the rotational roller printing machine 1, as is indicated by the signal line 18. Thus, an error message is transmited to the control device 17 of the rotational roller printing machine 1 as soon as the current measured values of the measuring heads 5 exceed a limit of tolerance defined in the central processing unit 12 of the control device. In such case, counter measures can be taken by means of the control device 17 at the side of the printing machine; e.g. the setting of the color system can be changed, as is indicated in FIG. 1 by signal line 19. Simultaneously, an alarm device 20 can be activated to alarm the operators. It is further possible to mark the products concerned by opening spray nozzles carrying suitable paint or to single them out by opening the sluices for waste sheets.

When the production is finished the data stored in the recording memory 10 can be analyzed according to various criteria. It has been proven sensible and meaningful to carry out an analysis of the so-called color location of the respective measuring point; three vectors assigned to the three basic colors are used. FIG. 2 is based on a respective diagram. This diagram shows the development of the color during the continuous printing process. Point 21 characterizes the ideal value. The field 22 surrounding the point 21 characterizes the spectral area within which the color has moved. It becomes obvious at a glance whether or not a tolerance limit, e.g. represented by a circle round the point 21, has been maintained.

A further possibility consists in recording the development of the color density with time. FIG. 3 is based on such a time-density-diagram. The illustrated example shows the progression of the color density of the three basic colors in relation to the production time. The lines 23 characterize the ideal progression. The curves 24 show the actual progression.

FIG. 4 illustrates a spectral distribution curve 25 that shows the spectral distribution of all colors within the assigned measuring area over the entire visible spectral range. It is possible to show the spectral distribution of individual measurements or an integration of several or of all measurements.

The present invention therefore constitutes an important element of reliable quality management. The present invention offers in particular the possibility to exactly proove that quality was produced so that unjustified complaints can be countered later.

We claim:

1. A device for carrying through quality management associated with an assigned measuring field on a printed product while printing a web on a rotational roller printing machine, comprising:

at least one measuring head spanning the width of the printed web, said at least one measuring head having a spectrometer and a light source, and being adjustable over the width of the printed web, said at least one measuring head generating measuring signals indicative of color density and the spectral distribution of color relative to the printed web;

an encoder for activating said at least one measuring head depending on the print product of the printed web; and a control device which continuously records the measuring signals generated by said at least one measuring head, wherein said at least one measuring head has a tube-shaped housing with a diameter exceeding the diameter of the assigned measuring field.

2. The device as defined in claim 1, wherein a plurality of measuring heads are provided, each being adjustable over the width of the printed web.

3. The device as defined in claim 1, further comprising:

a cross piece arranged horizontally across the width of the printed web, and wherein said at least one measuring head is mounted to said cross piece for movement there along.

4. The device as defined in claim 1, wherein said at least one measuring head is adjusted manually.

5. The device as defined in claim 1, wherein the light source comprises a flash.

6. The device as defined in claim 1, further comprising:

at least one reference measuring device.

7. The device as defined in claim 1, further comprising:

at least one device for compensating temperature fluctuations.

8. The device as defined in claim 1, further comprising:

at least one reference measuring device and at least one device for compensating temperature fluctuations.

9. The device as defined in claim 1, wherein the rotational roller printing machine has spaced apart dryer, cooler and folder and wherein said at least one measuring head is arranged an area between the dryer, cooler and folder.

10. The device as defined in claim 1, wherein said control device has a central processing unit for receiving the signals from said encoder and a sub-unit assigned to said at least one measuring head, said central processing unit containing a recording memory.

11. The device as defined in claim 10, wherein said central processing unit has an operating device.

12. The device as defined in claim 10, wherein said central processing unit has a display unit.

13. The device as defined in claim 10, wherein the rotational roller printing machine has a control unit, and wherein said central processing unit is connected to the control unit of the rotational roller printing machine.

14. The device at define in claim 10, further comprising:

an alarm unit connected to said control precessing unit.

15. The device at defined in claim 10, wherein the color system of the rotational roller printing machine is changed as a function of signals from said control processing unit.

* * * * *